United States Patent [19]

Willms

[11] 4,082,148

[45] Apr. 4, 1978

[54] FIRE PROTECTION SYSTEM

[75] Inventor: Charles F. Willms, Rutherford, N.J.

[73] Assignee: A-T-O Inc., Willoughby, Ohio

[21] Appl. No.: 708,491

[22] Filed: Jul. 26, 1976

[51] Int. Cl.[2] ..... A62C 37/04; A62C 37/06

[52] U.S. Cl. ..... 169/61; 169/18; 251/26

[58] Field of Search ..... 169/56, 60, 61, 65, 169/16–18, 26; 251/26, 44

[56] References Cited

U.S. PATENT DOCUMENTS

| | | | |
|---|---|---|---|
| 2,799,466 | 7/1957 | Hickerson | 251/44 X |
| 3,762,477 | 10/1973 | Mobley, Sr. | 169/14 |
| 3,865,192 | 2/1975 | Dunphy | 169/61 |

*Primary Examiner*—Robert W. Saifer

*Attorney, Agent, or Firm*—Webster B. Harpman

[57] ABSTRACT

A fire protection system for several zones of protection utilizes an expensive extinguishing agent and directs the extinguishing agent only to a zone in which a sensing device indicates the presence of a fire thus enabling the supply of the extinguishing agent to be delivered only to the fire zone and avoiding the necessity of charging the remainder of the system.

3 Claims, 2 Drawing Figures

FIG. 1
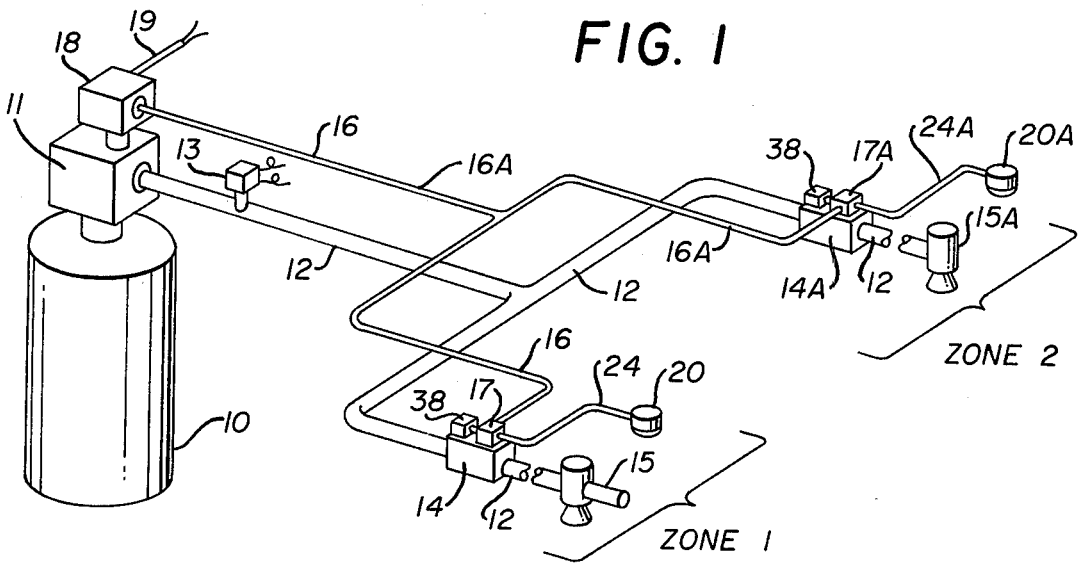
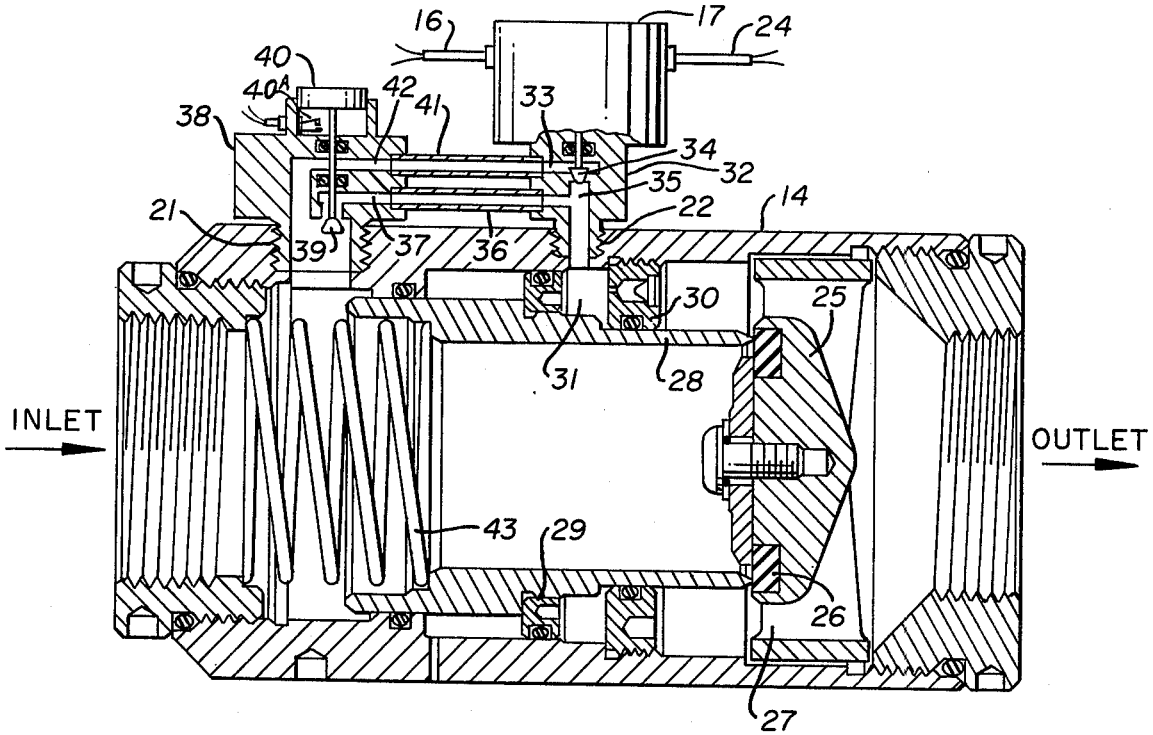
FIG. 2

FIRE PROTECTION SYSTEM

BACKGROUND OF THE INVENTION

1. Field of the Invention:

This invention relates to fire extinguishing systems covering several zones of protection and utilizing an extinguishing agent such as Halon.

2. Description of the Prior Art:

Prior fire protection systems have included means for detecting a fire in one of several protected areas and selectively directing a fire extinguishing medium such as chemicals and water to that area. See for example U.S. Pat. No. 3,762,477. Another fire extinguishing system incorporates a timer for directing periodic discharge of an extinguishing agent into a plurality of zones as disclosed in U.S. Pat. No. 3,921,722. Still another extinguishing system is disclosed in U.S. Pat. No. 3,866,687 wherein a plurality of discharge nozzles are individually controlled by individual heat and smoke detectors. U.S. Pat. No. 3,865,192 utilizes an optical scanning system and directs an extinguishing agent from a restricted source to a number of discharge nozzles in the system.

This invention utilizes a plurality of unique selector valves which divide the system into zones and which in turn are actuated by sensing devices in the zones so that the fire extinguishing agent supply need only supply the capacity for one protected zone in the system rather than have capacity for the entire system.

SUMMARY OF THE INVENTION

A fire protection system for several zones of protection includes a source of a sophisticated extinguishing agent and a distributing system extending to the several zones. Fire sensing devices in each of the zones control the initial discharge of the extinguishing agent to the system and selectively open one of a number of selector valves in the system to direct the extinguishing agent only to the zone in which the fire exists.

DESCRIPTION OF THE DRAWINGS

FIG. 1 is a perspective symbolic illustration of the fire protection system extended into two protected zones;

FIG. 2 is an enlarged cross sectional elevation of one of the selector valves in the system seen in FIG. 1.

DESCRIPTION OF THE PREFERRED EMBODIMENT

By referring to FIG. 1 of the drawings it will be seen that a replaceable cylinder 10 containing a suitable fire extinguishing agent such as Halon is in communication with a main control valve 11 which in turn establishes communication with distributing piping 12 in a fire protection system. An alarm switch 13 communicates with the distributing piping 12 and the piping 12 is extended into two protection zones which are indicated in FIG. 1 by the legends zone 1 and zone 2. Selector valves 14 and 14A control the flow of the fire extinguishing agent through the distributing piping 12 to several discharge nozzles 15 and 15A respectively and electrical circuits 16 and 16A extend from solenoid valves 17 and 17A on the selector valves 14 and 14A to the main control valve 11 by way of a junction box 18 which is connected with a power supply 19.

It will thus be seen that the distributing piping 12 of the fire protection system extends from the replaceable cylinder 10 which is the source of the fire extinguishing agent through the main control valve 11 and the selector valves 14 and 14A to the protected zones 1 and 2 and more specifically one or more of the discharge nozzles 15 and 15A as necessary in the respective protected zones 1 and 2.

The solenoid valves 17 and 17A are actuated by heat sensors 20 and 20A in the protected zones 1 and 2. Each of the selector valves 14 and 14A has a manually controlled actuating valve 39 as hereinafter described. The solenoid valves 17 and 17A include valve elements 34 which with the manually controlled valves 39 individually control passageways between a pair of ports 21 and 22 in each of the selector valves 14 and 14A. (See FIG. 2) The selector valves 14 and 14A are novel and one of them is illustrated in cross sectional detail in FIG. 2 of the drawings and hereinafter described.

Still referring to FIG. 1 of the drawings it will be seen that the heat sensors 20 and 20A are located one in each of the zones 1 and 2 and connected with the solenoid valves 17 and 17A by circuits 24 and 24A respectively and it will occur to those skilled in the art that the heat sensors may be thermostats or the like which close an electrical circuit upon a given temperature being reached. Alternately they may comprise any other heat or smoke sensitive device capable of actuating the solenoid valves 17 and 17A.

By referring now to FIG. 2 of the drawings it will be seen that one of the selector valves 14 has been illustrated and that it includes an inlet port in its left end and an outlet port in its right end and that communication between these ports is normally closed by a fixed valve seat member 25 which is provided with an annular resilient gasket 26 and mounted on a spider 27 in the cylindrical body of the selector valve 14. A cylindrical valve element 28 having an annular enlarged collar 29 thereabout is slidably and sealingly mounted in the cylindrical body of the selector valve 14 so that one of its ends is engageable with the resilient gasket 26 to form a closure between the inlet and outlet ports of the cylindrical body of the selector valve 14. A secondary annular collar 30 is positioned within the cylindrical body of the selector valve 14 to position the cylindrical valve element 28 in spaced relation to the inner walls of the cylindrical valve body of the selector valve 14 and so as to form an annular chamber 31 thereabout. The port 22 heretofore referred to establishes communication with the annular chamber 31 and the exterior of the selector valve 14 and mounts a fitting 32 having two separate passageways therein. One of these passageways 33 is controlled by a valve element 34 which is normally closed and is movable to an open position by the solenoid in the solenoid valve 17. The other passageway, indicated by the reference numeral 35 and it is normally open through the fitting 32 and it communicates with a tube 36 which in turn leads to a valve controlled passageway 37 in a secondary fitting 38 which is engaged in the port 21 in the selector valve 14 as heretofore referred to. The valve element 39 in the passageway 37 in the secondary fitting 38 is normally closed and is arranged to be actuated by a normally movable button 40.

A secondary tube 41 extends from the fitting 32 and communicates with the passageway 33 therein and with a passageway 42 in the secondary fitting 38 which in turn communicates with the interior of the cylindrical body of the selector valve 14 and in the area thereof adjacent the inlet port thereof.

In order that the cylindrical valve element 28 will normally be in closed relation with respect to the resilient gasket 26, a biasing spring 43 is positioned between a portion of the valve 14 defining the inlet port and an annular shoulder in the adjacent end of the cylindrical valve element 28. A plurality of O-ring seals are positioned between the respective parts as will be understood by those skilled in the art.

The fire protection system disclosed herein is normally energized with respect to the heat sensors 20 and 20A, the solenoid valves 17 and 17A are normally closed as are the manually controlled valves 39 in the fittings 38. The main control valve 11 is also closed and the fire extinguishing agent is contained in the replaceable cylinder 10. Upon one of the heat sensors 20 or 20A detecting a fire or an abnormal rise of temperature in the supervised area, the signal originated by the sensor travels back through the appropriate circuits and opens the selector valve 14 or 14A which controls the distributing piping 12 and the discharge nozzles 15 and 15A in the area of the sensor originating the signal. At the same time the signal travels back to the main control valve 11 on the cylinder 10 and opens the same and the fire extinguishing agent such as Halon then travels only through the distributing piping to the selector valves and from that point only through the distributing piping beyond the open selector valve thus eliminating the heretofore believed necessary charging of the entire system with the extinguishing agent. Pushing the button 40 actuates the system in the same way. An electric switch 40A in the fitting 38 closing a circuit with the main control valve 11 to open the same.

By referring to FIG. 2 of the drawings, it will be seen that the selector valves 14 and 14A operate by reason of the creation of a differential pressure in the angular chamber 31 upon the opening of either the solenoid control valve 34 in the passageway 33 or the manually control valve 39 in the passageway 37 as both of these passageways establish communication between the inlet port of the selector valve body 14 and the annular chamber 31 therein when their respective valves are open. Thus the extinguishing agent flows from the cylinder 10 through the main control valve 11 and the distributing piping 12 to the selector valve 14 and into the inlet end thereof. If the selector valve is the one controlling the discharge nozzles in the area of the fire or abnormal heat rise signalled by the sensor in that area then the solenoid control valve 34 is open and the pressure flows upwardly through the passageway 42, past the open solenoid actuated valve 34 and down into the annular chamber 31 where it builds up a differential pressure against the annular collar 29 which acts as a piston and causes the cylindrical valve element 28 to move to the left compressing the biasing spring 43 and opening with respect to the resilient gasket 26 whereupon the fire extinguishing agent flows axially through the selector valve 14 to the distributing piping 12 and the discharge nozzles in association therewith in the particular fire zone concerned.

It will be understood by those skilled in the art that while the manual control buttons 40 have been shown on the selector valves 14 and 14A they can be remotely positioned in a more convenient location in the particular fire zones protected so that they are conveniently accessible for manual operation in the individual fire zones.

It will thus be seen that the fire protection system disclosed herein enables a relatively small storage capacity of a desirable fire extinguishing agent such as Halon which is relatively expensive to be maintained in operative availability and discharged only in the area of a fire or abnormal temperature rise due to the operation of one of the selector valves 14 or 14A as the case may be.

Although but one embodiment of the present invention has been illustrated and described, it will be apparent to those skilled in the art that various changes and modifications may be made therein without departing from the spirit of the invention and having thus described my invention.

What I claim is:

1. A fire protection system for a plurality of zones comprising a temperature sensor in each of said zones and responsive to a critical temperature within said zone for providing a signal, a source of a fire extinguishing agent, distribution arranged in a main line and a plurality of secondary lines extending therefrom, each of said secondary lines extending into one of said zones, a first means for connecting said source of said fire extinguishing agent with said main line of said distribution piping, a plurality of secondary means for individually connecting said main line of said distribution piping to one of said secondary lines, said first means and one of said secondary means being simultaneously responsive in operation to a signal provided by one of said temperature sensors in one of said zones whereby said fire extinguishing agent is directed only to said one zone in which said sensor signals a critical temperature and wherein said secondary means comprises individual selector valves, each of which has a cylindrical body with inlet and outlet ends, a first valve element arranged for movement toward and away from a valve seat in said cylindrical body adjacent said outlet end thereof, spring means biasing said first valve element toward said valve seat, an annular chamber in said annular body, an annular collar on said valve element engaging said cylindrical body in said annular chamber, at least one passageway extending between said inlet end of said cylindrical body and said annular chamber, a secondary valve in said passageway in connection with one of said temperature sensors whereby opening said secondary valve permits the fire extinguishing agent to flow into said annular chamber and move said valve element to open position.

2. The fire protection system of claim 1 wherein there are two of said passageways and said secondary valve is in one of said passageways and a third valve is in the other of said two passageways, a solenoid for operating said secondary valve and a manually movable member for operating said third valve.

3. The fire protection system of claim 1 wherein there are two of said passageways and said secondary valve is in one of said passageways and a third valve is in the other of said two passageways, a solenoid for operating said secondary valve and a manually movable member for operating said third valve, an electrical switch in said third valve, means connecting said electrical switch with said main control valve whereby actuation of said manually movable member causes said main control valve and one of said individual selector valves to open.

* * * * *